US005169346A

United States Patent [19]

Johnston

[11] Patent Number: 5,169,346

[45] Date of Patent: Dec. 8, 1992

[54] DATA CONNECTOR/MODULAR JACK ADAPTER AND METHOD FOR MAKING

[76] Inventor: James J. Johnston, 110 Faith Rd., Newington, Conn. 06111

[21] Appl. No.: 803,121

[22] Filed: Dec. 4, 1991

[51] Int. Cl.[5] ..... H01R 13/627

[52] U.S. Cl. ..... 439/676; 439/607

[58] Field of Search ..... 439/628, 638-640, 439/676, 607-610

[56] References Cited

U.S. PATENT DOCUMENTS 4,975,078 12/1990 Stroede et al. ..... 439/676
5,059,140 10/1991 Philippson et al. ..... 439/676
5,087,210 2/1992 Myers et al. ..... 439/676

*Primary Examiner*—Joseph H. McGlynn

*Attorney, Agent, or Firm*—McCormick, Paulding & Huber

[57] ABSTRACT

An hermaphroditic IBM data connector/modular communication jack adapter made by encapsulating a modified standard modular telecommunication jack receptacle within a modified IBM data connector of attached cable type. Resilient solid wire contacts associated with the jack receptacle are terminated by insulation displacing contacts on and within the data connector. Terminal portions of at least two of the solid wire contacts are bent to positions overlying the jack receptacle casing. Plates cut from a shield enclosure which forms a part of the data connector are positioned in overlying relation to the terminal portions of the two solid wire contacts and establish ground drain continuity between the jack receptacle and the data connector.

18 Claims, 6 Drawing Sheets

DATA CONNECTOR/MODULAR JACK ADAPTER AND METHOD FOR MAKING

BACKGROUND OF THE INVENTION

This invention relates in general to an improved data connector/modular telecommunication jack adapter and to a method for making such an adapter. More specifically, the present invention pertains to an improved IBM data connecter/modular jack adapter for use in accessing a token ring cabling system via modular two pair or three pair telephone (RJ11 or RJ45) jacks and which is compatible with IBM part numbers 6091000 and 8310574 as an interface for a distribution patch panel or information outlets.

Such adapters as heretofore available for the aforesaid purposes are relatively large and have multiple internal soldered connections joining each one of the data connector contacts and an associated one of the modular jack contacts which comprise the adapter.

It is the general aim of the present invention to provide an improved data connector/modular telecommunication jack adapter of small size wherein each one of the data connector contacts is internally connected to an associated one of the jack contacts by a single solderless IDC connection and a method for modifying an existing data connector and one or more existing telecommunication jack receptacles to make such an adapter.

SUMMARY OF THE INVENTION

In accordance with the present invention an IBM data connector/modular telecommunication jack adapter comprises a hollow generally rectangular housing defining a forwardly open cavity and including a pair of opposing side walls, and a rear wall which has an opening through it communicating with the cavity. A modular telecommunication jack receptacle disposed within the housing has a casing including a rear part disposed within and generally complementing the opening in the rear wall. The casing defines a rearwardly open jack receiving recess and has a rearwardly facing shoulder which engages the rear wall within the cavity. A plurality of resilient solid wire first contacts are mounted on the casing. Each first contact has a jack engaging portion disposed within the jack receiving recess and a terminal portion extending from the forward end of the casing. A contact carrier assembly partially disposed within the cavity generally forward of the casing includes a contact carrier and a plurality of second contacts mounted on the carrier. The contact carrier has forwardly open first contact recess in its forward end partially defined by a forwardly projecting lip. An upwardly and rearwardly open second contact recess rearwardly spaced from the first contact recess is formed in a rear portion of the contact carrier. Each of the second contacts has a forward end portion which defines a contact surface exposed within the first contact recess and an integral insulation displacing contact portion disposed within the second contact recess. A plurality of the terminal portions of the first contacts are terminated by the associated insulation displacing contact portions of the second contacts. A means is provided for securing the modular telecommunication jack receptacle and the contact carrier assembly in assembled relation with the housing.

The adapter is made by modifying an IBM data connector housing to receive therein a modified modular telecommunication jack receptacle having resilient solid wire contacts, terminating a plurality of the wire contacts by forcibly inserting a terminal end portion of each wire contact into an insulation displacing portion of an associated data connector contact mounted on a contact carrier which comprises a part of the data connector, and encapsulating the telecommunication jack receptacle within the data connector housing by assembling the contact carrier within the housing forward of the jack receptacle.

DETAILED DESCRIPTION OF PREFERRED METHOD AND EMBODIMENT

Figure 1:
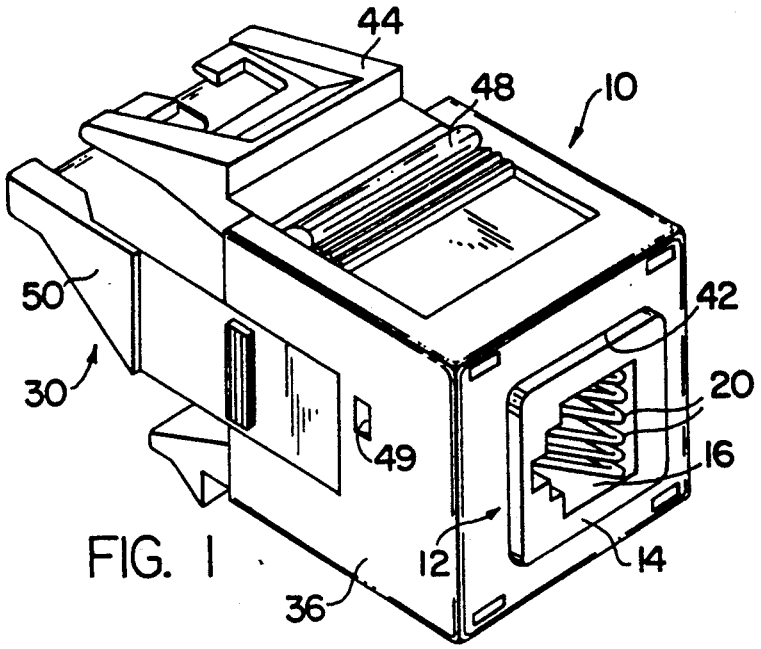
FIG. 1 is a perspective view of an hermaphroditic IBM data connector/telecommunication jack adapter made in accordance with and embodying the present invention.
Figure 3:
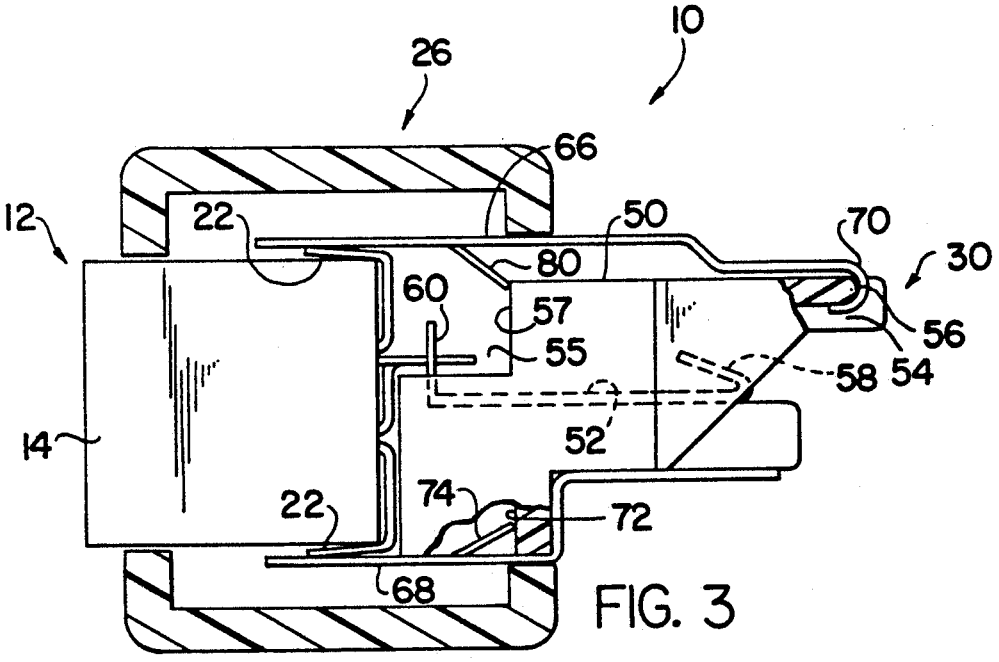
FIG. 3 is a somewhat enlarged schematic side elevational view of the data connector/telecommunication jack adapter shown partially in vertical section.
Figure 2:
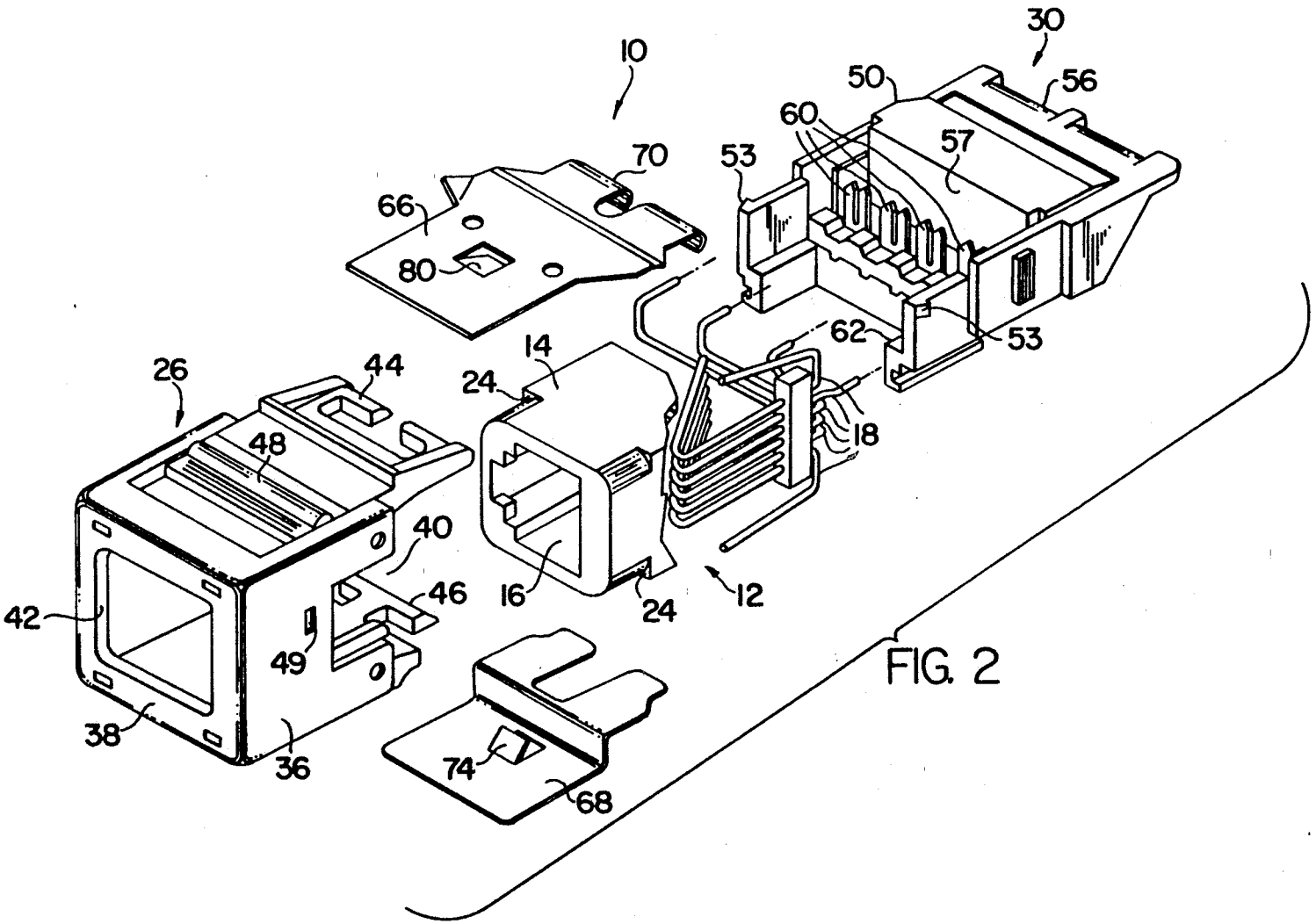
FIG. 2 is an exploded perspective view of the data connector/telecommunication jack adapter of FIG. 1.

In the drawings and in the description which follows, the invention is illustrated and described with reference to an adapter for coupling a modular telecommunication jack to an hermaphroditic IBM-type data connector. The illustrated adapter, indicated generally by the reference numeral 10 in FIGS. 1–3, is made by modifying an existing telecommunication jack receptacle, modifying an existing IBM-type data connector to encapsulate the modified jack receptacle, and electrically connecting selected contacts of the modified jack receptacle to insulation displacement contact portions of the modified data connector within the connector housing, all of which will be hereinafter more fully discussed.

In the further description which follows, terms such as upper, lower, front, rear, top, bottom and side are employed to describe the relative positions of the various component parts which comprise the adapter as oriented in the drawings. However, it should be understood that an adapter made in accordance with and embodying the present invention may be used in any orientation.

Figure 4:
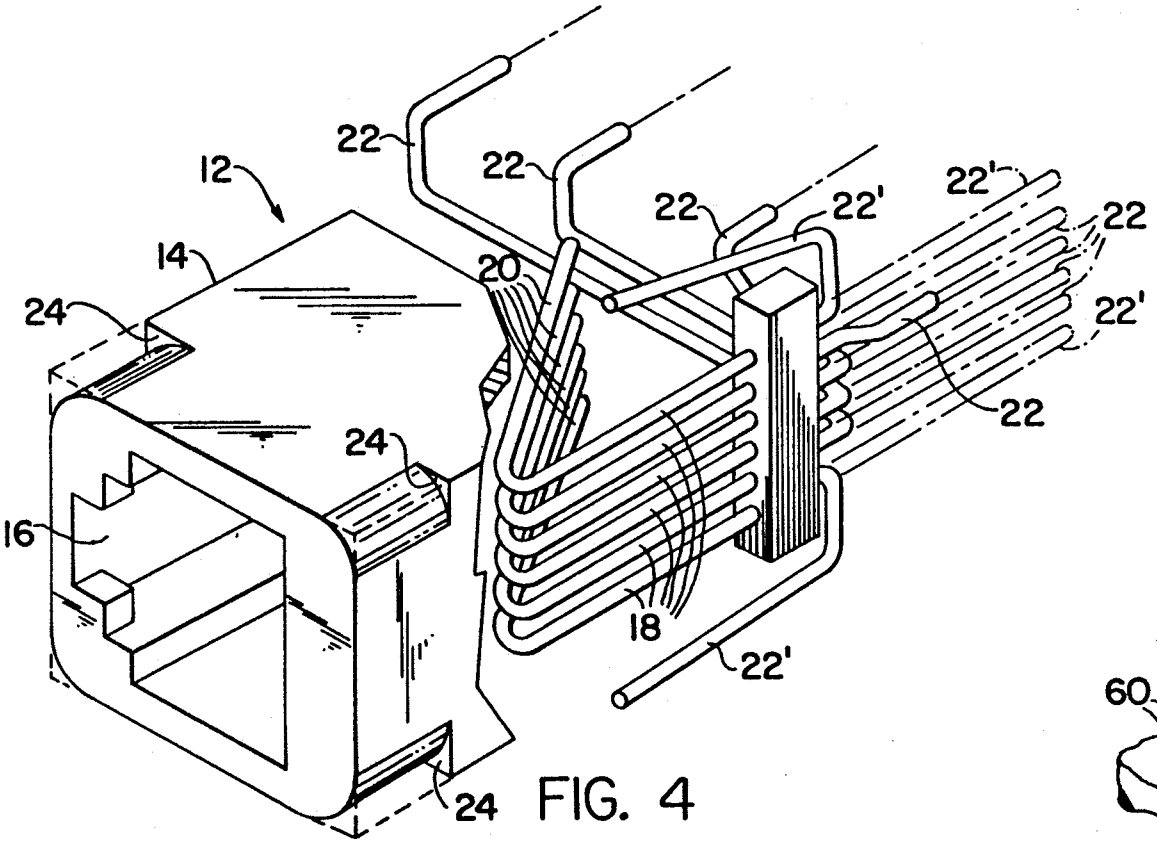
FIG. 4 is a somewhat further enlarged exploded rear perspective view of a telecommunication jack receptacle modified in accordance with the invention.

Referring now particularly to FIG. 4, a standard telecommunication jack receptacle used in making the adapter 10 and modified in accordance with the invention is indicated generally by the reference numeral 12. The illustrated jack receptacle 12 has a hollow generally rectangular casing 14 made from a suitable dielectric material, such as a polyester. A standard jack receiving recess 16 for receiving a telephone jack opens through the back wall of the casing 14, substantially as shown. The jack receptacle further includes a plurality of resilient solid wire contact 18 mounted in the casing 14. The number of contacts may vary. However, the illustrated jack receptacle 12 has six such contacts indicated at 18,18. Each contact 18 has a jack engaging portion 20 disposed within the jack receiving recess 16. Four of the contacts have terminal portions 22,22 which are bent to extend forwardly from and beyond the front end of the casing 14. Two of the contacts 18,18 have terminal portions 22',22' which are bent to extend in a generally rearward direction, for a purpose which will be hereinafter evident. In FIG. 4 the various terminal portions indicated at 22,22 and 22',22' are shown in full lines after having been bent to various sequential positions and trimmed to length for assembly, the initial positions of the terminal portions 22,22 and 22',22' before bending and trimming being indicated by broken lines.

In accordance with the method of the present invention, the modular telecommunication jack receptacle 12 is modified by providing at least one rearwardly facing shoulder 24 on the casing 14, but preferably, and as shown, four rearwardly facing shoulders 24,24 are provided. The shoulders are formed on the casing by relieving or milling rear portions of the casing to remove the corners defined by the intersections of the top and bottom surfaces with the side surfaces of the casing, as best shown in FIG. 4 where portions of the casing 14 removed by the milling operation are shown in broken lines.

Figure 5:
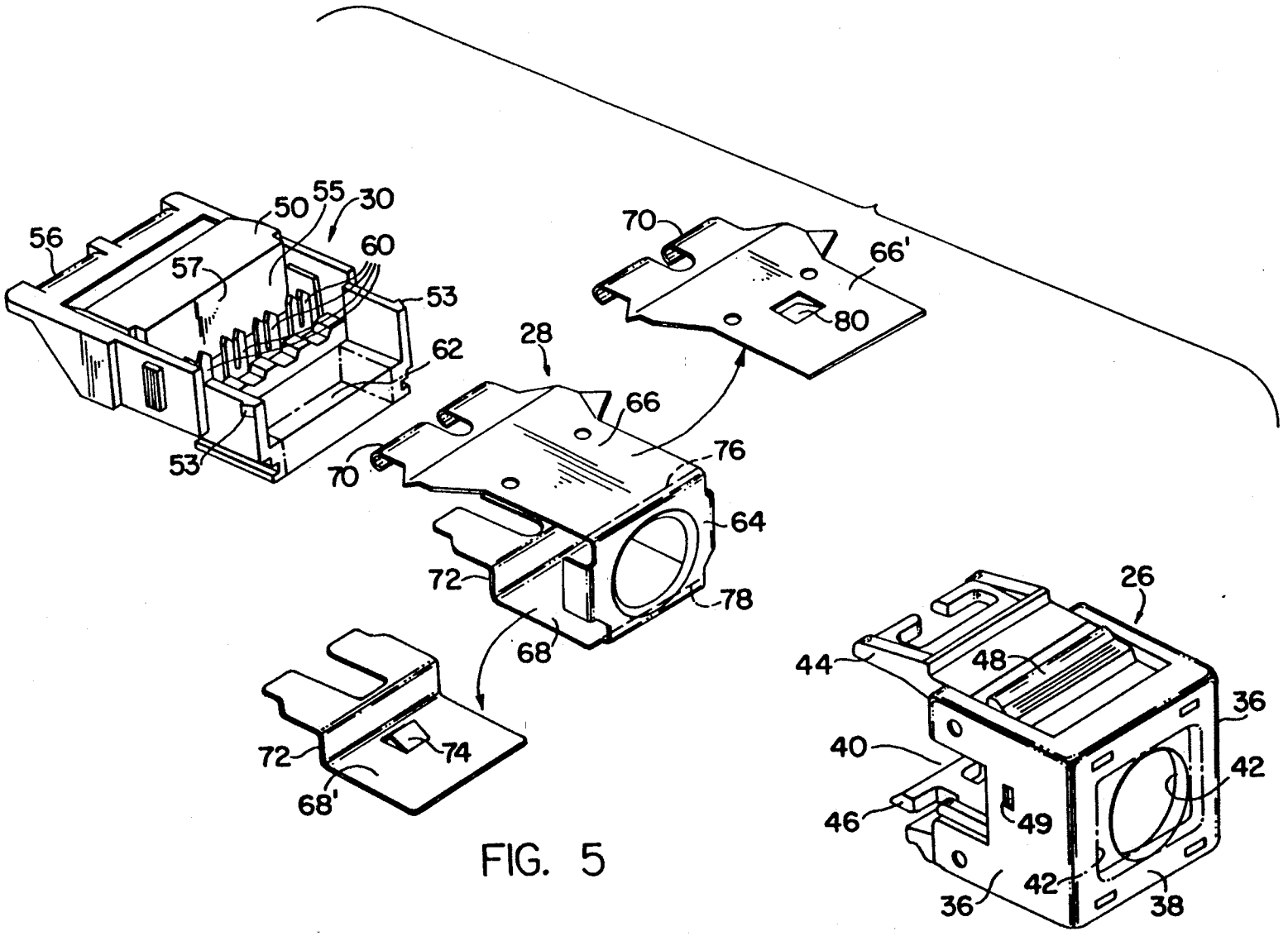
FIG. 5 is an exploded rear perspective view of an IBM data connector modified in accordance with the invention, modifications to the connector being shown in broken lines.

The remaining parts of the adapter 10 comprise modified parts of an IBM data connector of cable attached type, manufactured by RIT Ltd., Tel-Aviv, Israel. The components of the RIT IBM data connector used in making the adapter 10 are shown in FIG. 5 and include a housing, indicated generally at 26, a shielding enclosure, designated generally by the numeral 28, and an interconnection module or contact carrier assembly, designated generally at 30. Other parts of the RIT data connector not used in making the present adapter are not shown.

The housing 26 is generally rectangular, made from a resilient dielectric material such as glass reinforced polyester, and has a pair of opposing side walls 36, 36 and a rear end wall 38 which cooperate to define a forwardly open cavity 40. The rear wall has a generally circular cable receiving opening 42 through it. The opening 42, shown in full lines in FIG. 5, communicates with the interior of the housing 26.

A pair of mutually complementary catch members which include a female member 44 and a male member 46 are supported within openings in the upper and lower portions of the housing 26 for pivotal movement on the housing and toward and away from each other between holding and releasing positions. Each of the catch members 44 and 46 carries an associated locking slide 48 for securing the member in its holding position. A pair of latch receiving openings 49,49 formed in the sidewalls 36,36 cooperate with latch members 53,53 on the contact carrier assembly 30 to retain the data connector in assembly, as will be hereinafter discussed, all of which is well known in art.

The housing 26 is modified in accordance with the present invention by enlarging and reshaping the cable receiving opening 42 to receive and substantially complement the modified rear end portion of the jack receptacle casing 14. The enlarged opening is generally rectangular, indicated at 42' and shown in broken lines in FIG. 5 and in full lines in FIGS. 1 and 2.

The contact carrier assembly 30 includes a generally rectangular contact carrier 50 made from dielectric material, such as glass reinforced polyester, and a plurality of metallic electrical contacts 52,52 mounted on the contact carrier 50. The latch members 53,53 project from opposite sides of the contact carrier 50 for snap-in engagement within the latch receiving openings 49,49 to retain the contact carrier assembly in assembled relation with the housing 26, as previously noted. A forwardly open first contact receiving recess 54 is formed in the contact carrier and partially defined by a forwardly projecting lip 56. A rearwardly and upwardly open second contact receiving recess 55 is formed in the rear portion of the contact carrier 50 and partially defined by a rearwardly facing surface 57. The contacts 52,52, one shown in FIG. 3 are mounted in fixed position on the contact carrier 50 and disposed in laterally spaced apart relation to each other. Each contact 52 has a forward end portion 58 exposed within the first contact receiving recess 54 and an insulation displacing portion 60 disposed within the second contact receiving recess 56.

The contact carrier assembly 30 is modified by cutting a rearwardly open notch 62 in the contact carrier 50 immediately rearward of the insulation displacing contact portions 60,60 to receive an associated portion of the casing 14, the notch 62 being shown in broken lines in FIG. 5 and in full lines in FIG. 2. The lateral width of the notch 62 is substantially equal to the lateral width of the jack receptacle casing 14 so that the contact carrier 50 straddles the associated forward end part of the casing 14 when the modular jack receptacle 12 is assembled with the contact carrier.

The shielding enclosure 28, which normally comprises a part of the IBM data connector, is formed from sheet metal and has a rear portion 64 and top and bottom shielding plates, indicated at 66 and 68, respectively, integrally connected to and projecting forwardly from the rear portion 64, substantially as shown in FIG. 5. The free edge at the forward end of the top plate 66 is turned downwardly and rearwardly, as indicate at 70, to cooperate in gripping engagement with the lip 56 when the shielding enclosure 28 is assembled with the contact carrier assembly 30 as shown in FIG. 3. The bottom shielding plate 68 has a stepped configuration as viewed from the side and includes an intermediate wall 72. A locking tab 74 struck from the bottom plate 68 cooperates with the intermediate wall 72 to receive an associated portion of a wall of the contact carrier 50 therebetween whereby the shielding enclosure 28 is connected to the contact carrier.

The shielding enclosure 28 is modified in accordance with the present invention for use in making the adapter 10 by separating the top and bottom shielding plates 66 and 68 from each other or more specifically from the rear portion 64 which is not used and may be discarded. This separating operation is preferably performed by cutting or shearing the top and bottom shielding plates 66 and 68 immediately forward of the rear portion 64 and along lines of shear shown in FIG. 5 and indicated at 76 and 78, respectively. The separated top shielding plate, indicated at 66' is further modified by striking at least one tab 80 from it, substantially as shown in FIG. 5 and FIG. 2. The tab 80 extends forwardly and downwardly away from the upper surface of the top plate 66' and engages the associated rearwardly facing surface 57 on the contact carrier 50, substantially as shown in FIG. 3. Thus, the tab 80 cooperates with the forward end portion 70 to secure the top shielding plate 66' to the contact carrier 50.

Preferably and as shown the modified telecommunication jack receptacle has a greater number of contacts than the contact carrier with which it is assembled to form a part of the adapter 10. As previously noted, the illustrated jack receptacle 12 has six resilient solid wire contacts 18,18, whereas the contact carrier 50 has only four formed metal contacts 52,52. The two wire contacts 18,18 having terminal portions 22,'22 are employed to establish electrical grounding continuity between the jack receptacle 12 and the hermaphroditic jack defined by the forward end of the contact carrier 30, as will be further evident from the description which follows.

Figure 6:
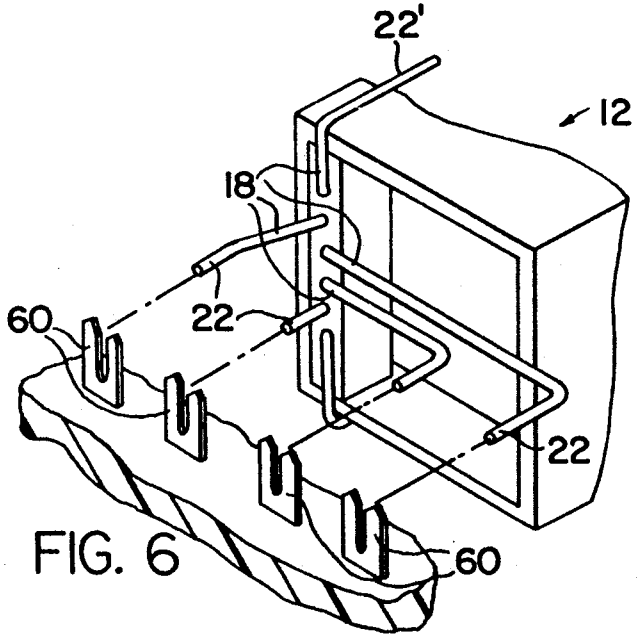
FIGS. 6–8 are fragmentary front perspective views illustrating various sequential arrangements for termination of the resilient wire contacts which comprise the telecommunication jack receptacle of FIG. 4.
Figure 7:
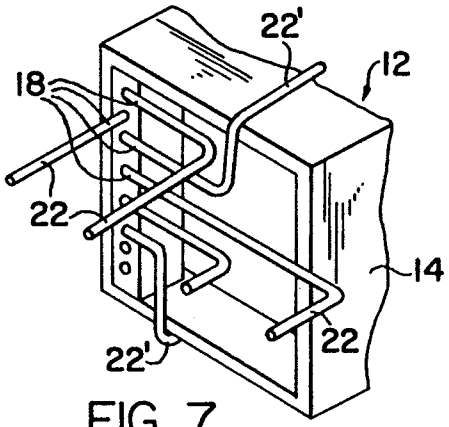
Figure 8:
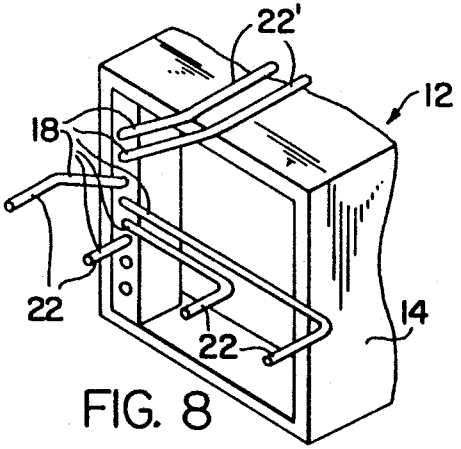

Preparatory to assembling the adapter 10, a subassembly is formed by joining the jack receptacle 12 to the contact carrier assembly 30. The contacts 18,18 on the jack receptacle are first bent and trimmed to length, as required, for proper termination within the insulation displacing portions 60,60 on the contact carrier. The sequence of termination may vary and will be determined by the circuit paths to be established through the adapter 10. One such arrangement of circuit paths is shown in FIG. 2. Examples of other bent forms of the contacts 18,18 which provide other circuit paths appear in FIGS. 6–8.

The resilient wire contacts 18,18 which form the ground drain leads are also bent to position and trimmed to length, as necessary. In accordance with the preferred termination sequence shown in FIGS. 1 and 4 a ground drain lead is formed by the uppermost terminal portion 22' which is bent upwardly and rearwardly to a position generally overlying and slightly upwardly inclined away from the upper surface of the casing 14. In like manner the lowermost terminal portion 22' is trimmed to length and bent downwardly and rearwardly to a position immediately underlying and slightly inclined downwardly and away from the lower surface of the casing 14 to form another ground drain lead.

After the leads 18,18 have been bent and trimmed a forward end portion of the jack receptacle casing 14 is inserted into the notch 62 to bring the rear end portion of the contact carrier assembly 30 into straddling relation to a forward end portion of the casing 14. Each of the illustrated four wire contacts 18,18 is then forcibly inserted into an associated one of the insulation displacing portions 60,60 to complete the jack receptacle/contact carrier sub-assembly.

The top shielding plate 66' is then positioned in overlying relation to the upper surface of the contact carrier 50 with its free edge 70 in gripping engagement with the lip 56 and its retaining tab 80 engaging the associated rearwardly facing wall 57. The top shielding plate 66' is now restrained against forward and rearward movement relative to the contact carrier 50. The rear end portion of the plate 66' will now be disposed in overlying relation to the upper ground drain lead 18' which is resiliently biased toward and into contacting engagement with the plate 66'.

In like manner, the bottom shielding 68' is assembled with and in substantially underlying relation to the contact carrier 50 with its locking tab 74 and its intermediate wall 72 in cooperating relation to an associated wall of the contact carrier whereby the lower plate is restrained against forward and rearward movement relative to the contact carrier 50. The rearwardly extending portion of the bottom shielding plate 68' is now disposed in substantially underlying grounding engagement with the lower ground drain lead 18' which is resiliently biased toward and into contacting engagement with the plate 68'.

The entire assembly which includes the jack receptacle/contact carrier sub-assembly and the top and bottom shielding plates 66' and 68' is now inserted into the cavity 40 so that the rear end portion of the casing 14 enters the enlarged opening 42'. Rearward movement of the casing 14 relative to the housing 26 is arrested when the rearwardly facing shoulders 24,24 engage the inner surface of the rear end wall 38. When the casing 14 attains the latter position the latch members 53,53 on the contact carrier 50 snap into latching position within the latch receiving openings 49,49 in the usual manner to retain the adapter 10 in assembled condition ready for use.

Figure 9:
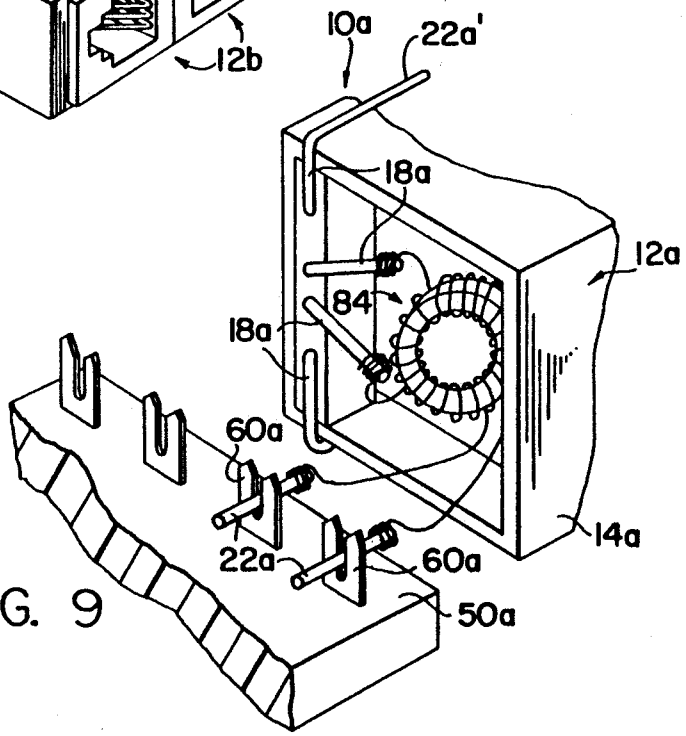
FIG. 9 is a somewhat schematic fragmentary front perspective view of another adapter embodying the invention.

A portion of another adapter embodying the present invention and which includes a line-balance converter or balun indicated generally at 84 is shown somewhat schematically in FIG. 9 and indicated generally at **10*a*. The adapter 10*a* includes a modular jack receptacle indicated generally at 12*a* and a contact carrier assembly 30*a*. The adapter 10*a* is similar to the adapter 10 previously described, but is formed by mounting each lead of the balun 84 in series with and between the opposite end portions of a resilient solid wire contact 18*a* and terminating the free end of the latter contact within an associated insulation displacing portion 60*a*, in the manner shown in FIG. 9. Any suitable means may be employed for securing the balun 84 and a potting compound (not shown) may, for example, be used to secure the balun within a recess in the forward end of the casing 14*a***, substantially as shown.

Figure 10:
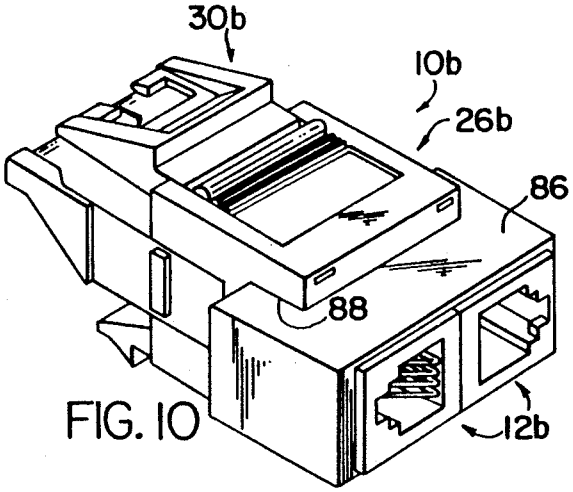
FIG. 10 is a perspective view of a dual jack adapter embodying the invention.

FIG. 10 illustrates a dual jack adapter embodying the present invention and indicated generally at **10*b*. The illustrated adapter 10*b* is used to couple a plurality of modular telecommunication jacks to another hermaphroditic data connector. The adapter 10*b* is also made by modifying an IBM data connector. However, the data connector housing 26*b* is modified to encapsulate at least two telecommunication jack receptacles 12*b*,12*b* and electrically connecting the resilient wire contacts of each the jack receptacles to the contacts of the modified data connector or more specifically to the insulation displacing portions of the contact carrier 30*b* contained within the data connector housing 26*b***, substantially as previously described.

The data connector housing **26*b* is modified by attaching to it a hollow generally rectangular housing extension 86. The housing extension 86 has a forwardly open recess for receiving a plurality of modular jack receptacles, such as the illustrated two jack receptacles 12*b*,12*b*. The housing extension 86 is secured in fixed position within an opening or notch 88 formed in the data connector housing 26*b*, substantially as shown. Rearwardly facing shoulders 24*b*,24*b* formed on the jack receptacles but not shown engage the inner surface of a rear wall of the housing extension 86 in the manner of the shoulders 26,26, previously described, when the jack receptacles 12b,12b** are inserted into the housing extension.

Figure 11:
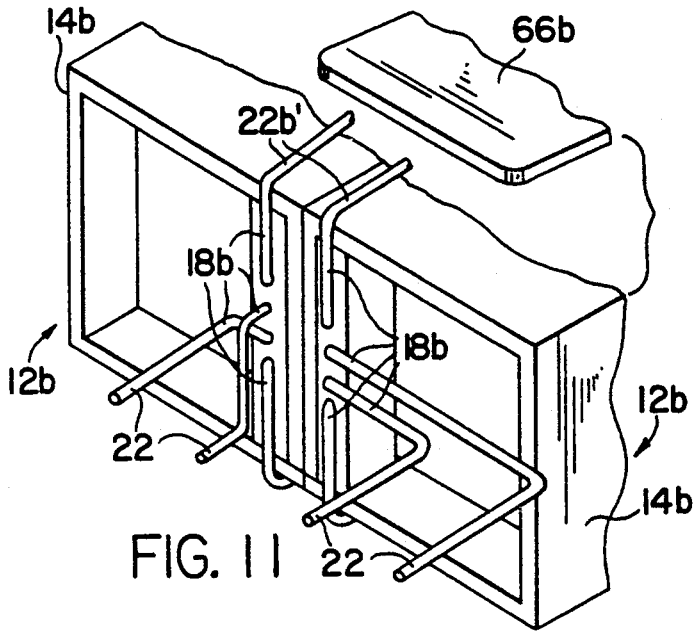
FIGS. 11 and 12 are similar to FIGS. 6–8 but illustrate sequential arrangements for termination of the wire contacts for the dual jack adapter of FIG. 10.
Figure 12:
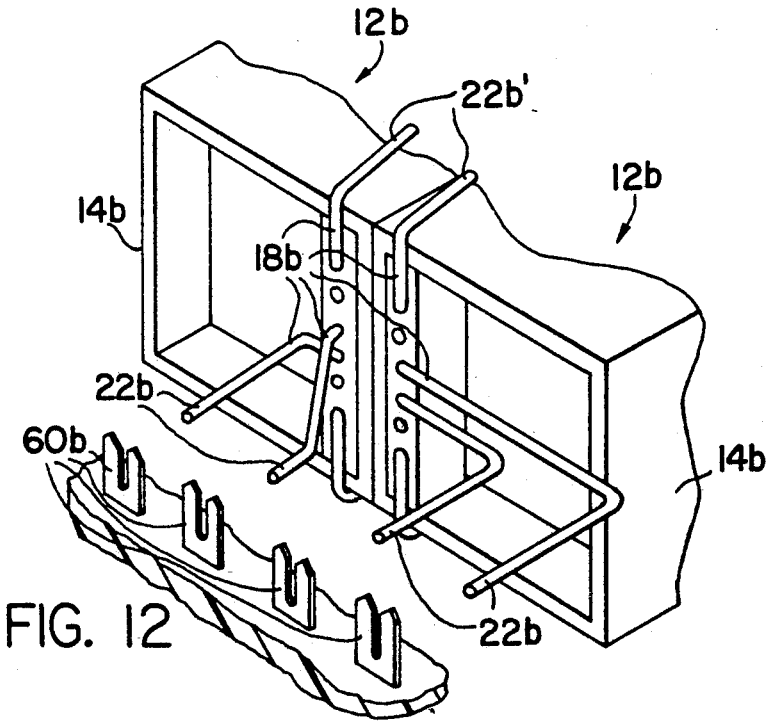

The solid wire contacts 18b,18b associated with the modular jack receptacles 12b,12b may be formed as shown in FIGS. 10 and 11, for example. Preferably, and as shown the terminal portions 22b',22b' which comprise the ground drain leads, are located at the inboard sides of the jack receptacle, substantially as shown, so that a single upper plate 66b', shown in FIG. 11 and a single lower plate (not shown) may be employed to establish grounding continuity between both jack receptacles 12b,12b and an associated contact carrier assembly 30b). It should now be apparent that the assembly may be made substantially in the manner previously described with reference to the adapter 10.

The data connector/telecommunication jack adapters of the present invention may be used to access a token ring cabling system via modular two or four wire telephone (RJ11 or RJ45) jacks/plugs. The adapter is plug compatible to IBM part number 6091000 and 8310574, as an interface for a distribution patch panel or information outlets. The adapters of the present invention also allow telephone patch cords to access different equipment interfaced with cableless baluns. This provides the option of integrating RS 232,coaxial, twin axial or BNC/TNC (Wang) systems across and existing token ring cabling network.

I claim:

1. An hermaphroditic data connector/telecommunication adapter comprising a housing having a rear wall and opposing sidewalls and defining a forwardly open cavity, said rear wall having at least one opening therethrough, at least one modular telecommunication jack receptacle received within said cavity, said jack receptacle having a casing defining a rearwardly open jack receiving recess, a plurality of resilient wire contacts mounted on said jack receptacle, said wire contacts defining first contact portions disposed within said jack receiving recess and terminal end portions extending from the forward end of said casing, said casing extending into said one opening and having a rearwardly facing abutment surface thereon engaging an associated forwardly facing surface of said rear wall, a contact carrier assembly at least partially disposed within said housing forward of said one jack receptacle and including a contact carrier and a plurality of data connector contacts mounted on said contact carrier, each of said data connector contacts having a second contact portion exposed at the forward end of said adapter and an insulation displacing portion disposed within said cavity, each one of a plurality of said terminal end portions being terminated within said housing by an associated one of said insulation displacing portions, and securing means for releasably retaining said contact carrier and said one jack receptacle in assembly with said housing.

2. An hermaphroditic data connector/telecommunication adapter as set forth in claim 1 including a balun contained within said housing and having leads and each of said leads is connected in series with an associated one of said wire contacts between said first contact portion and said terminal end portion of said associated one wire contact.

3. A data connector/telecommunication adapter as set forth in claim 1 including at least one shielding plate overlying an associated surface of said contact carrier and having a portion thereof exposed at the forward end of said contact carrier, means for retaining said one plate against forward and rearward movement relative to said contact carrier, at least one of said terminal end portions being resiliently biased into engagement with said one plate.

4. A data connector/telecommunication adapter as set forth in claim 3 wherein said one terminal end portion is disposed between said one plate and said casing.

5. A data connector/telecommunication adapter as set forth in claim 1 having a pair of individual shielding plates, each of said shielding plates overlying an associated surface of said contact carrier, means for retaining said plates against forward and rearward movement relative to said contact carrier, one of said terminal end portions being resiliently biased into engagement with said one of said plates and another of said terminal end portions being resiliently biased into engagement with the said other of said plates.

6. A data connector/telecommunication adapter as set forth in claim 5 wherein said one terminal end portion is disposed between said one plate and said casing and said other terminal end portion is disposed between said other plate and said casing.

7. An hermaphroditic data connector/telecommunication adapter as set forth in claim 1 including a plurality of modular telecommunication jack receptacles received within said cavity.

8. An hermaphroditic data connector/telecommunication adapter as set forth in claim 7 including at least one shielding plate overlying an associated surface of said contact carrier and wherein at least one of said terminal end portions of each of said jack receptacles is disposed between said casing and said one plate and resiliently biased into engagement with said one plate.

9. An hermaphroditic data connector/telecommunication adapter as set forth in claim 1 wherein said securing means comprises cooperating means on said housing and said contact carrier.

10. An hermaphroditic data connector/telecommunication adapter as set forth in claim 9 wherein said cooperating means comprises a latch receiving opening in said housing and a latch member on said contact carrier for snap-in engagement within said latch receiving opening.

11. An IBM data connector/modular telecommunication jack adapter comprising a generally rectangular housing including a top wall, a bottom wall, a pair of opposing side walls and a rear end wall and defining a forwardly open cavity, said rear wall having an opening therethrough, a modular telecommunication jack receptacle disposed within said housing and having a casing including a rear part disposed within and generally complementing said opening, said casing having a rearwardly facing shoulder engaging said rear wall within said cavity, said casing defining a rearwardly open jack receiving recess exposed externally of said housing, a plurality of resilient solid wire contacts mounted in said casing, each of said solid wire contacts having a first contact portion disposed within said jack receiving recess and a terminal portion extending from the forward end of said casing, a contact carrier assembly having a contact carrier partially disposed within said cavity generally forward of and in straddling relation relative to and associated forward end portion of said casing, said contact carrier including a forwardly open first contact recess partially defined by a forwardly projecting lip extending forwardly beyond said first contact recess and an upwardly and rearwardly open second contact rearwardly spaced from said first contact recess, said contact carrier assembly including a plurality of electrical contacts mounted on said contact carrier, each of said electrical contacts having a forward end portion defining a contact surface exposed within said first contact recess and an integral insulation displacing contact portion disposed within said second contact recess, a plurality of said terminal portions being terminated by said insulation displacing contacts, and means for securing said modular telecommunication jack receptacle and said contact carrier assembly in assembled relation with said housing.

12. An IBM data connector/telecommunication jack adapter as set forth in claim 11 including upper and lower shielding plates overlying associated portions of the upper and lower surfaces of said contact carrier and said casing, at least one of said terminal end portions being disposed between said casing and an associated one of said plates and biased into engagement with said one plate.

13. A method for modifying an IBM data connector to make an IBM data connector/modular telecommunication jack adapter, the data connector having a generally rectangular housing including a top wall, a bottom wall, a pair of opposing side walls and a rear wall cooperating to define a forwardly open cavity, the rear wall having a cable receiving opening therethrough, a contact carrier assembly including a contact carrier for mounting on the housing partially within the cavity and having a forwardly open first contact recess partially defined by a forwardly projecting lip extending forwardly beyond the first contact recess, a generally upwardly and rearwardly open second contact recess, and a plurality of electrical contacts mounted on the contact carrier, each of said electrical contacts having a forward end portion defining a contact surface exposed within the first contact recess and an insulation displacing portion disposed within the second contact recess, said method comprising the steps of providing a modular telecommunication jack receptacle having a generally rectangular casing defining a rearwardly open jack receiving opening, and a plurality of resilient solid wire contacts mounted within the casing, each of the wire contacts having a jack engaging portion disposed within the jack receiving opening and a terminal portion extending forwardly from and beyond the front end of the casing, forming a rearwardly facing shoulder on the casing spaced forwardly of the back end of the casing, enlarging the cable receiving opening in the housing to generally complement the cross-section of the back end portion of the casing, forming a rearwardly open notch in the contact carrier rearward to the second contact recess for receiving an associated forward end portion of the casing, positioning the forward end portion of the casing in the notch, terminating a plurality of the terminal portions within associated insulation displacing portions and thereby connecting the telecommunication jack receptacle to the contact carrier, inserting the telecommunication jack receptacle and the contact carrier into the cavity after the jack receptacle has been connected to the contact carrier, positioning the back end portion of the casing within the enlarged cable receiving opening, bringing the shoulder into engagement with the rear wall of the housing, and securing the contact carrier to the housing.

14. A method for modifying an IBM data connector as set forth in claim 13 wherein the data connector includes a shielding enclosure formed from flat metal and having a rear plate portion and top and bottom shielding plate portions connected to said rear plate portion and extending forwardly therefrom in overlying relation to associated upper and lower surface portions of the contact carrier, the upper plate having a downwardly and rearwardly turned forward end portion engaging the lip, the bottom plate having retaining means thereon cooperating with an associated wall of said contact carrier for restraining the shielding enclosure against forward and rearward movement relative to the carrier when the shielding enclosure is assembled with the contact carrier, said method comprising the further steps of bending at least one of the terminal portions outwardly about an associated forward edge of the casing and to a rearwardly and outwardly inclined position relative to one wall of the casing, separating at least one of the shielding plate portions from the remainder of the shielding enclosure, discarding the remainder of the shielding enclosure, and positioning the one shielding plate portion on the contact carrier and in generally overlying relation to the one wall and the one terminal portion and in engagement with the one terminal portion.

15. A method for modifying an IBM data connector as set forth in claim 13 wherein the data connector includes a shielding enclosure formed from flat metal and having a rear plate portion and top and bottom plate portions connected to said rear plate portion and extending forwardly therefrom in overlying relation to associated upper and lower surface portions of the contact carrier, the upper plate portion having a downwardly and rearwardly turned forward end for engaging the lip, the bottom plate portion having retaining means thereon cooperating with an associated wall of said contact carrier for restraining the shielding enclosure against forward and rearward movement relative to the contact carrier when the shielding enclosure is assembled with the contact carrier, said method comprising the further steps of bending one of the terminal portions upward and about an associated forward edge of the casing and to a rearwardly and upwardly inclined position relative to the upper wall of the casing, bending another of the terminal portions downward and about an associated forward edge of the casing and to a rearwardly and downwardly inclined position relative to the lower wall of the casing, separating the top and bottom plate portions from the rear plate portion, discarding the rear plate portion, positioning the top plate portion on the contact carrier in generally overlying relation to the upper wall of the casing and the one terminal portion, and positioning the bottom plate portion on the contact carrier and in overlying relation to the lower wall of the casing and the other terminal portion.

16. A method for modifying an IBM data connector as set forth in claim 15 including the additional step of forming a tab on the top plate portion for cooperating with the lip and the contact carrier to restrain the top plate portion against forward and rearward movement relative to the contact carrier.

17. A method for modifying an IBM data connector to make a data connector/telecommunication jack adapter, said data connector having a housing including a cable receiving opening in the rear thereof, said housing defining a forwardly open cavity, a contact carrier assembly received within the cavity and including a contact carrier and a plurality of electrical contacts mounted on the contact carrier and having insulation displacing portions disposed within the cavity, and retaining means for securing the contact carrier assembly in assembled relationship with the housing, said method comprising the steps of providing at least one telecommunication jack receptacle having a casing defining a rearwardly open jack receiving recess, a plurality of resilient wire contacts mounted on the casing and having contact portions disposed within the jack receiving recess and terminal end portions extending beyond the forward end of the casing, removing a rear portion of the casing to accommodate the one jack receptacle within the housing, terminating a plurality of the terminal end portions on the one jack receptacle within the insulation displacing portions to form a jack receptacle/contact carrier assembly, inserting the jack receptacle/contact carrier assembly into the cavity, and securing the contact carrier in assembly with the housing by the retaining means.

18. A method for modifying an IBM data connector as set forth in claim 17 wherein the step of providing at least one standard telecommunication jack receptacle is further characterized as providing a plurality of jack receptacles, and including the additional step of attaching an extension to the rear portion of the housing to accommodate the plurality of jack receptacles within the cavity, the step of attaching to be performed after the step of removing a portion of the rear of the housing.

* * * * *